US007405671B2

(12) United States Patent
Sebescak

(10) Patent No.: US 7,405,671 B2
(45) Date of Patent: Jul. 29, 2008

(54) POWER FAILURE ALARM

(76) Inventor: Andrew J. Sebescak, 444 Wesley Ln., Westmont, IL (US) 60559

( * ) Notice: Subject to any disclaimer, the term of this patent is extended or adjusted under 35 U.S.C. 154(b) by 88 days.

(21) Appl. No.: 11/160,641

(22) Filed: Jul. 1, 2005

(65) Prior Publication Data

US 2007/0001866 A1 Jan. 4, 2007

(51) Int. Cl.
*G08B 17/10* (2006.01)

(52) U.S. Cl. ..... 340/628; 340/654; 340/635; 340/652; 340/638; 340/644; 340/693.5

(58) Field of Classification Search ..... 340/628, 340/586.4, 635, 652, 638, 644, 656, 654, 340/693.5, 693.4
See application file for complete search history.

(56) References Cited

U.S. PATENT DOCUMENTS 4,074,245 A * 2/1978 Podany ..... 340/654
5,663,711 A * 9/1997 Sanders et al. ..... 340/635
6,229,450 B1 * 5/2001 Malmsten ..... 340/652
7,009,514 B2 * 3/2006 Dupeire ..... 340/568.4

* cited by examiner

*Primary Examiner*—Tai T Nguyen
(74) *Attorney, Agent, or Firm*—Michael L. Greenberg, Esq.; Greenberg & Lieberman LLC

(57) ABSTRACT

A power failure alarm for use in sounding a warning in the occasion of a power failure, with built in electrical connectors, and a temporary source of light. The device is housed in a molded plastic enclosure in a rectangular shape and includes an emergency light, night-light, flashlight, and power failure alarm. All unit functions are completely automatic once the unit has been plugged into a standard 120 volt receptacle. The device has a three prong male plug on the back of the body and is designed to occupy one receptacle of a duplex receptacle thus leaving one receptacle still available for use. Alternate embodiments of the device are specifically intended to alert and notify the user of a power failure. The device utilized logic circuitry to determine if a power failure or improper setup has occurred. The battery charging and monitoring circuits ensure the batteries are always charged and ready for use.

11 Claims, 4 Drawing Sheets

POWER FAILURE ALARM

FIELD OF THE INVENTION

The present invention relates to a power failure alarm device, and more particularly, to a device that not only generates an audible signal to indicate when a connected power source has failed, but also is configured to incorporate a portable lamp and may be used in a variety of applications including refrigeration. An option available on this device will also alert the user when a power failure has occurred when connected to a standard dialup phone line.

BACKGROUND OF THE INVENTION

Numerous electrical appliances in home and commercial businesses require a continuous supply of electrical power in order to function, such as refrigerators, freezers, lamps, computers, clocks, and critical medical equipment. Most of these devices gain electrical power by connecting to a main power supply via a plug into a wall receptacle. However, on occasions these devices may become inoperable through a power failure, accidental unplugging, turning off the power switch, or a tripped circuit breaker. These occasions can happen without becoming noticeable. It is not uncommon for a motor driven appliance to fail and open the fuse or circuit breaker. Quite often a homeowner is not aware of the motor failure until it is too late, for example refrigerated food is spoiled or the basement is flooded.

Supermarkets use multiple refrigerators providing open storage of chilled or frozen foods, thus if an unnoticed power failure occurs, the consequence would result in a large loss of inventory and revenue. Even though most commercial refrigeration is monitored by temperature alarm systems, an alarm on the power source would provide early warning of an imminent temperature rise.

Various devices have been created to aid in situations of power failure.

Japanese application no. 0631 9019 of Ogino Isao Shiga Shigeo on Nov. 15, 1994 discusses an emergency flashlight holder. Unlike the present invention, Shigeo's invention is a flashlight only, not intended to provide a security light while plugged in. Additionally the present invention is compact allowing for easier and less cumbersome operation.

Japanese application no. 1169445 of Kobayashi Yoshitsugu on Jun. 16, 1999 discusses a power failure alarming device. Unlike the present invention, Yoshitsugu's invention does not operate each plug separately. Additionally the option for a telephone alert is not present.

Japanese application no. 2000219241 of Akita Toshaki on Jul. 19, 2000 discusses a failure alarm indication device. Unlike the present invention Toshaki's invention does not have an audible alarm.

Thus, there is a need for a power failure alarm that alerts of a power failure, provides a reliable source of temporary light, gives users sufficient time to take action, alerts users of a power failure at a specific piece of equipment, as well as may be used in various other applications.

SUMMARY OF THE INVENTION

The present invention is a power failure alarm device designed to plug into any standard 120-volt receptacle. The basic device incorporates two lamps, a light level sensor, rechargeable battery, battery charging indicator and a selector switch in a compact unit. The unit is housed in a molded plastic enclosure approximately 2½"×5"×1¼". In this configuration the unit provides four functions: power failure alarm, emergency light, rechargeable flashlight, and a nightlight. A two-position selector switch located on the body of the device controls the function of the flashlight. The switch positions are labeled On and Off. All other functions of the unit operate automatically when plugged into a standard 120-volt receptacle. Upon loss of power the audible alert will sound and emergency light will illuminate.

In an alternative embodiment the present invention is specifically designed as a power failure alarm only, with optional "notification" capability. This configuration is housed in a molded plastic enclosure approximately 3"×4½"×2". In this embodiment it is intended to plug into both outlets of a duplex wall receptacle. Two, two-position selector switches are located on the front of the device and allows the user to activate or deactivate the unit, by outlet. The switch positions are labeled Normal-Off. This alternative embodiment of the present invention includes two three prong male plugs on the back of the unit and two three prong female receptacles on the bottom of the unit. This allows the user to plug the device into a duplex wall receptacle and continue to use both outlets of the duplex receptacle. Upon loss of power the audible alert will sound and, if equipped with the notification option, the device will notify the user via phone of the power failure.

A further alternative embodiment of the present invention is designed for commercial applications and must be installed by a qualified electrician. This unit is available in several different voltage configurations, 120 volt, 208/240 volt, and 277/480 volt. This configuration is specifically designed for the commercial refrigeration market but can have applications on other critical equipment such as heating equipment or ejector pumps. The alternative embodiment of the present invention will be hardwired into the power source of any critical piece of equipment and will alert users of a power failure. This embodiment is similar in operation and features to the duplex receptacle embodiment with optional "dial out capability" except that it further incorporates a set of "auxiliary contacts" (single pole–double throw) that can be connected to a building automation or security system to notify a remote location of a power failure.

DETAILED DESCRIPTION OF THE PREFERRED EMBODIMENT(S)

Figure 1A:
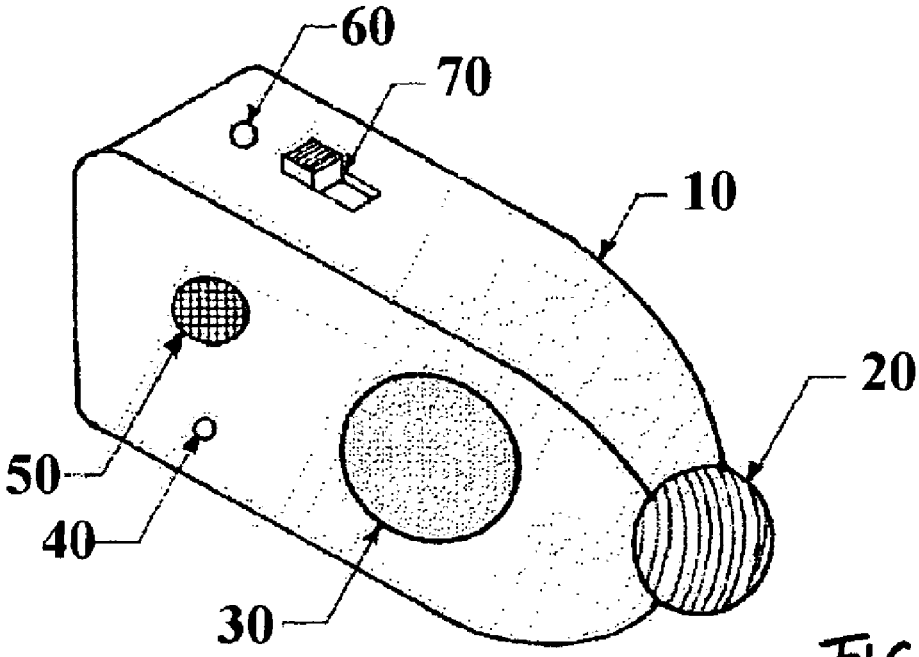
FIG. 1A shows a first environmental view of the present invention.

The present invention is a power failure alarm device comprised of a pulsating audible alert signal, emergency light (also functions as a conventional flashlight), automatic nightlight with light level sensor, rechargeable battery with battery charging circuitry, charging indicator, two position selector switch for flashlight operation and logic circuitry configured in a compact body. As shown in FIG. 1A the body (10) is in a rectangular shape that tapers to the front of the present invention where the emergency light/flashlight lens (20) is located. The present invention is approximately 2½"×5"×1¼" yet, these proportions are illustrative for example purposes and can be increased, decreased, or modified to meet desired design considerations.

Figure 1B:
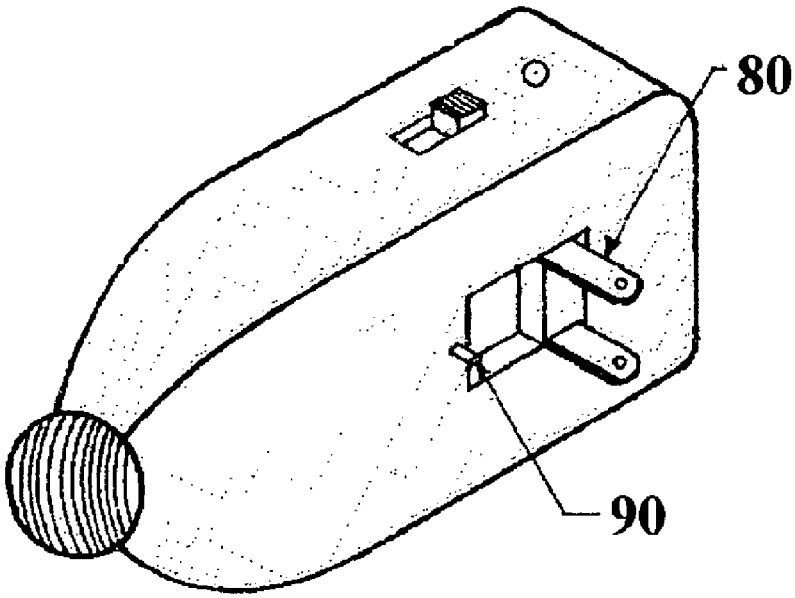
FIG. 1B shows a second environmental view of the present invention.

The night-light lens (30), light level sensor (40) and audible signal (50) are located on the front of the present invention. Located on the top of the present invention is the charging indicator light (60) and flashlight selector switch (70). As shown in FIG. 1B, the back of the present invention has a "fold away" two-prong plug (80) and "sensing pin" (90).

Emergency Light/Flashlight (20) will be designed as a "Bright White" LED (light emitting diode) array, potentially having four to six LEDs installed in a reflector protected by a transparent lens. The current intent is that the rechargeable battery (located within the present invention) will provide continuous operation of the Emergency Light/Flashlight (20) for a minimum of four hours.

The night-light (30) will be one or two "Bright White" LEDs protected by a transparent plastic lens. The night-light (30) will operate automatically through the light level sensor (40) whenever the present invention is plugged into a 120 volt receptacle and AC power is available.

The audible signal (50) will be a pulsating alert at a frequency of approximately 2900 Hz at a minimum of 85 decibels.

The rechargeable batteries (located with the present invention) are currently planned to be Nickel-Metal Hydride because of their high energy density, rapid charge ability, excellent life cycle and excellent discharge profile. However, the battery type may change due to advancements in battery technology or design considerations.

When the present invention is plugged into a live receptacle, the charging light (60) will illuminate indicating that the present invention is operating. After the initial charge the present invention will function automatically. The spring loaded sensing pin (90) on the backside of the present invention activates an internal switch (not shown) that detects when the present invention is plugged into a receptacle.

Present invention Plugged in, Power Available, Switch (70) in On or Off Position When the present invention is plugged into a receptacle and AC power is available the night-light (30) will illuminate when the ambient light level drops below a predetermined level and shut off when the ambient light level rises above a predetermined level. The Emergency Light/Flashlight (20) will remain off.

Present invention Plugged in, Loss of Power, Switch (70) in On or Off Position It is recommended that the switch (70) be left in the "On" position when the present invention is plugged into a receptacle. Upon loss of power the audible signal (50) will sound and the Emergency Light/Flashlight (20) will illuminate regardless of switch (70) position. The audible signal (50) will continue to sound until the present invention is removed from the receptacle. When the present invention is removed from the receptacle the spring loaded sensing pin (90) will activate an internal switch (not shown) and recognize that the present invention has been removed from the receptacle and silence the audible signal (50). The Emergency Light/Flashlight (20) will remain illuminated so long as the switch (70) is in the recommended "On" position. When the present invention is removed from the receptacle it functions as a conventional flashlight. Placing the switch (70) in the "Off" position will shut off the flashlight function.

Figure 2:
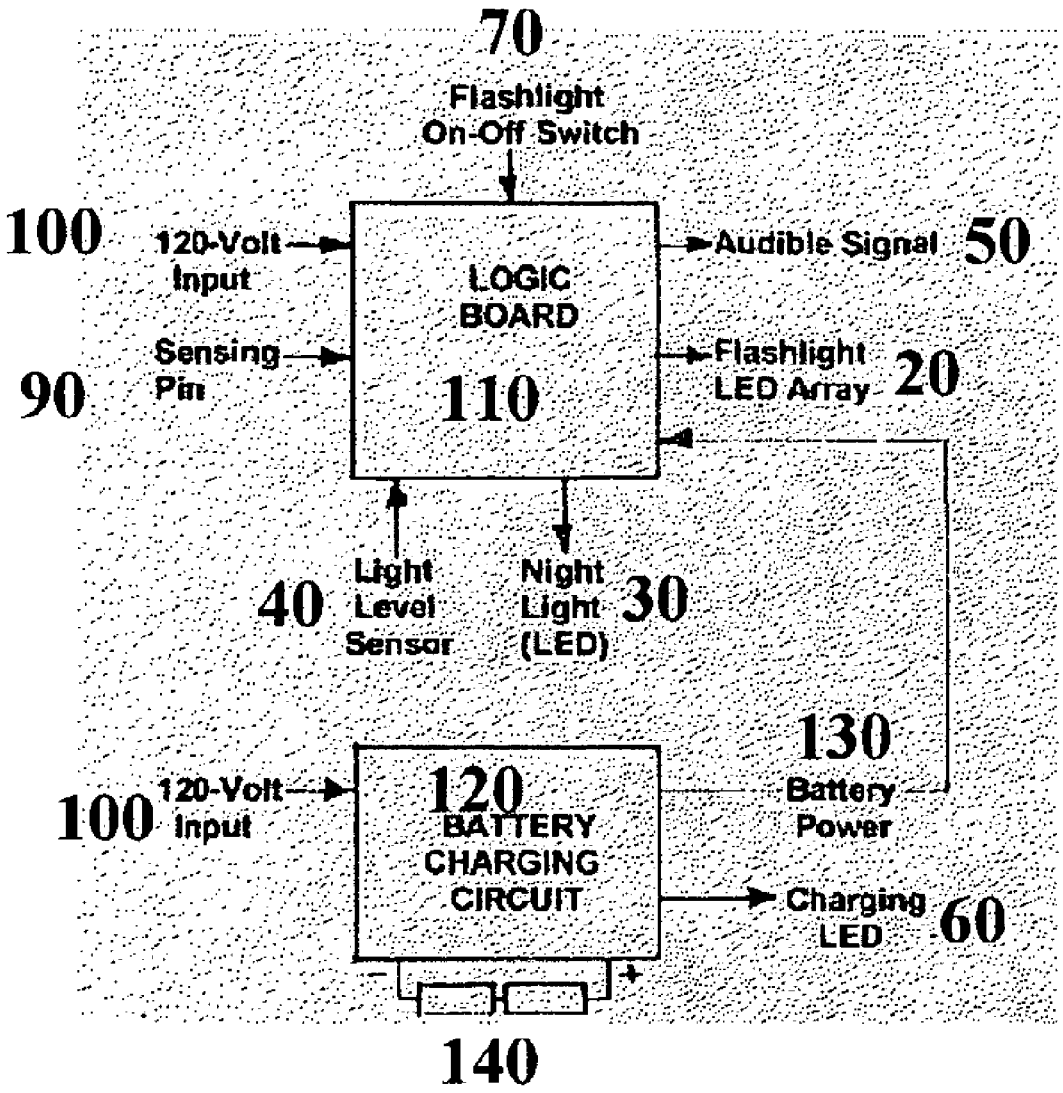
FIG. 2 shows the circuitry of the present invention.

Referring to FIG. 2, the circuitry is depicted in a block diagram. 120-volt power (100) is supplied to the logic board (110) and battery charging circuit (120). The logic board (110) uses a DC power supply to provide power to the logic components (explained further hereafter). Inputs to the logic board are: light level sensor (40), On-Off switch (70), sensing pin (90) (momentary switch) and DC power (130) from the rechargeable batteries (140). Outputs are: night-light LED (30), audible alert (50) and Emergency Light/Flashlight (20) LED array. The battery charging circuitry (120) has temperature and timing circuits (not shown) to monitor the status of the battery pack to ensure the batteries (140) are not over charged or charged too rapidly. The charging light (60) will flash on and off if the batteries (140) are not fully charged. The charging light (60) will remain continuously illuminated when the batteries (140) are fully charged and ready for use.

Also shown is an alternative embodiment of the present invention configured specifically as a power failure alarm only. The alternative embodiment of the present invention is specifically configured for the residential market to alert homeowners of a complete power failure or failure of power at a particular receptacle. Specific applications are critical appliances such as refrigerators, freezers and sump pumps. It is not uncommon for a motor driven appliance to fail and open the protection device (fuse or circuit breaker). Quite often the homeowner is not aware of the motor failure until it is too late and severe repercussions have occurred. The present invention will actuate the audible signal (180) the moment the motor fails and opens the protection device, thus giving the homeowner sufficient time to take action. An additional feature of the present invention monitors the presence of the appliance power cord when it is plugged into the present invention. When the appliance power cord is intentionally or accidentally removed from the present invention, the audible alert (180) will sound, even though power is still available at the receptacle.

Figure 3A:
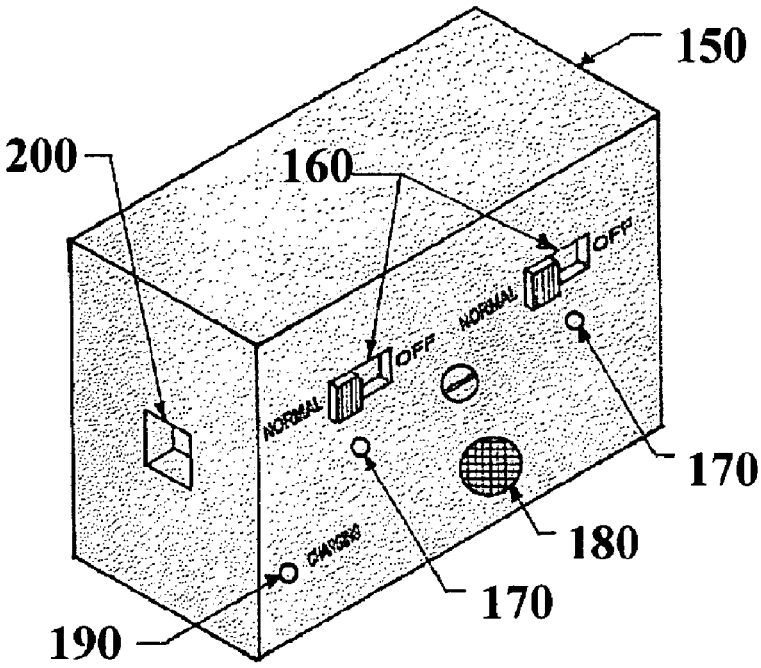
FIG. 3A shows a front view of a second embodiment of the present invention.

FIG. 3A depicts the front view of this configuration. This configuration is housed in a molded plastic enclosure (150) approximately 3–×4½"×2". In this embodiment it is intended to plug into both outlets of a duplex wall receptacle. So that the present invention is securely attached to the receptacle, the cover plate screw is removed from the receptacle before the present invention is plugged in. Once the present invention is in place a longer screw (240), provided with the present invention, is used to secure the device to the receptacle through the cover plate screw hole (not shown). This allows the user to plug the present invention into a duplex wall receptacle and continue to use both outlets of the duplex receptacle. Two, two-position selector switches (160) are located on the front of the present invention which allows the user to activate or deactivate the alarm function (180) of each outlet. Adjacent to each selector switch (160) is an LED (170) that will flash on and off when the associated receptacle is in alarm. The switch (160) positions are labeled Normal-Off. Also located on the front of the present invention is the audible alarm signal (180) and charging light (190). Located on the left side of the present invention is the RJ-11 phone jack (200) provided on units equipped with the optional telephone dial out capability.

Figure 3B:
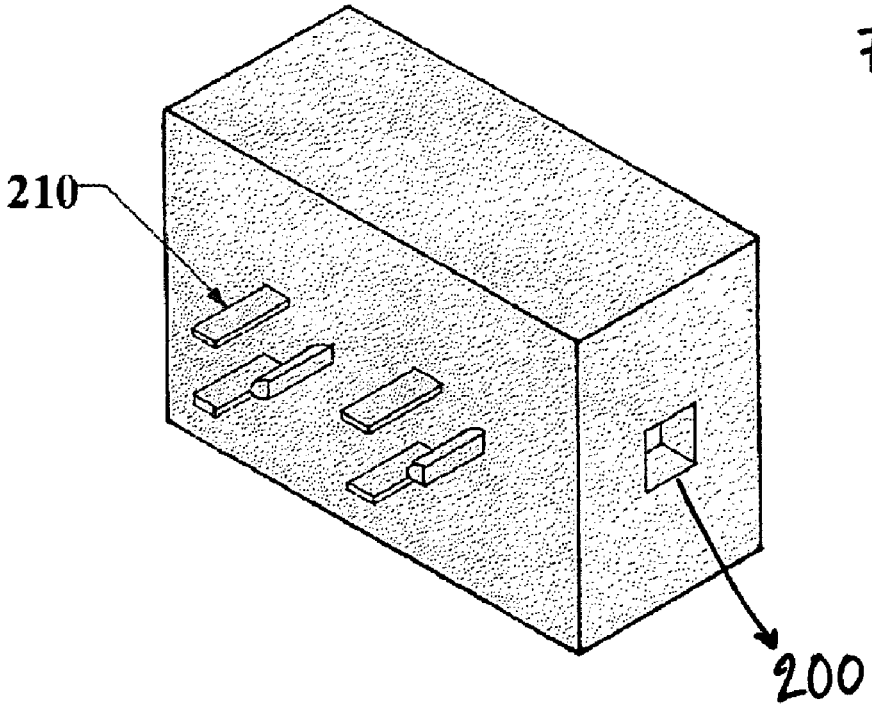
FIG. 3B shows a back view of a second embodiment of the present invention.

FIG. 3B depicts the back view of this configuration. This alternative embodiment of the present invention has two three prong male plugs (210).

Figure 3C:
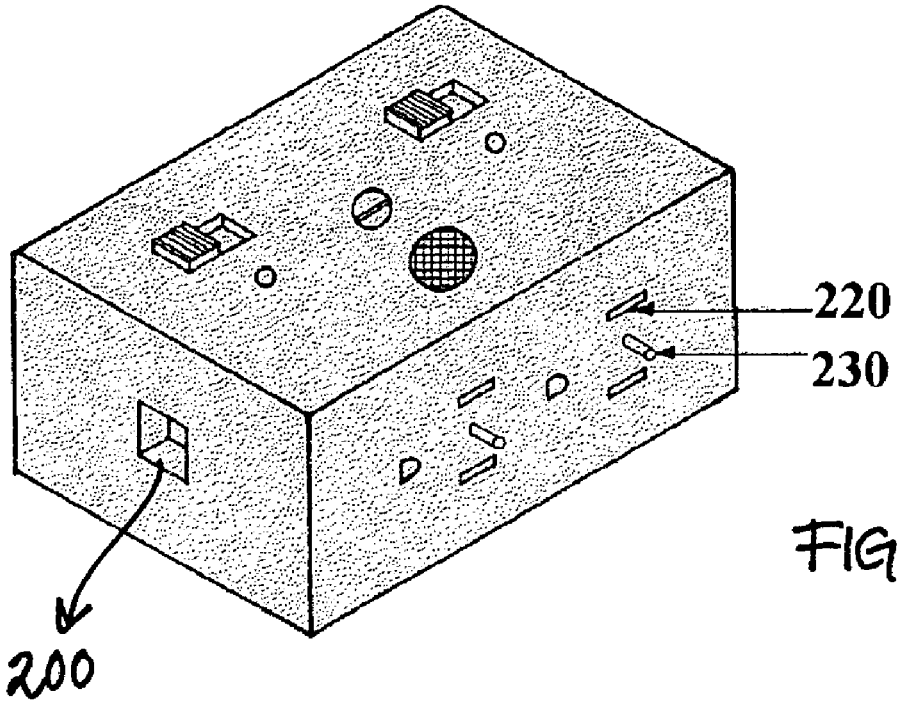
FIG. 3C shows a bottom view of a second embodiment of the present invention.

FIG. 3C depicts the bottom side view of this configuration. This alternative embodiment of the present invention includes two three prong female receptacles (220) and the sensing pins (230) for each receptacle.

Some duplex wall receptacles are fed from two separate circuits. In order to maintain this electrical separation, the present invention monitors each outlet individually. Each outlet of the device incorporates a sensing pin (230) to determine if an appliance is plugged into either of the outlets. This configuration is specifically designed to alert homeowners of a complete power failure, failure of power at a particular receptacle or if the cord to the appliance has been intentionally or accidentally removed from the receptacle.

When the present invention is plugged into a live receptacle the charging light (190) will flash on and off until the batteries (not shown) are fully charged. The charging light (190) will remain continuously illuminated when the batteries (not shown) are fully charged and ready for use.

Figure 4:
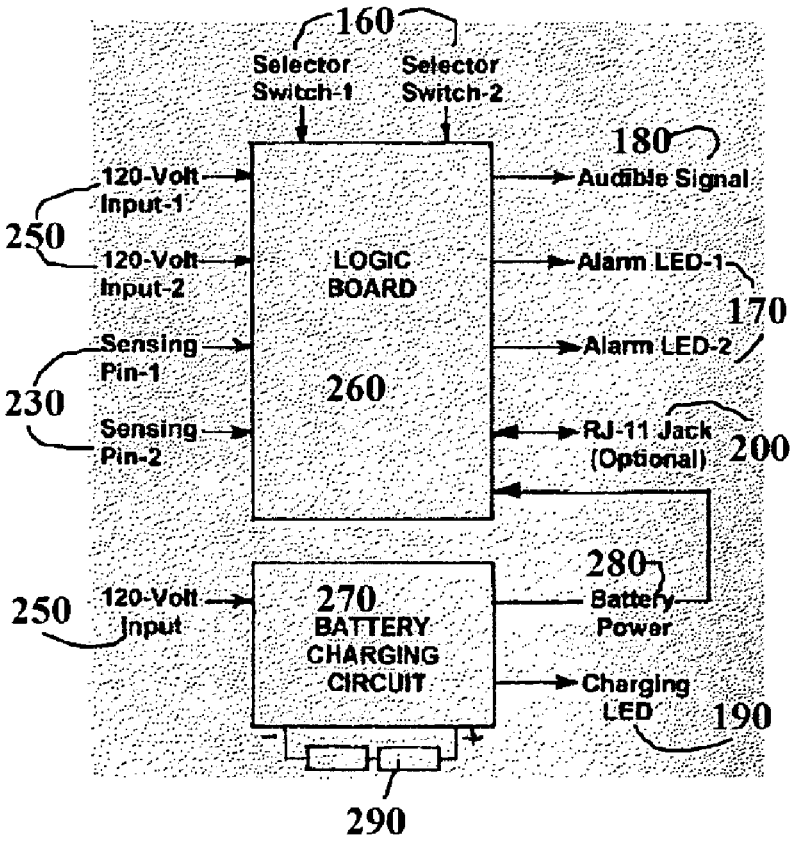
FIG. 4 shows the circuitry of a second embodiment of the present invention.

The charging, logic circuitry and batteries are similar to the components used in the basic embodiment of the device and is demonstrated in drawing 4. Referring to FIG. 4, the circuitry is depicted in a block diagram. Two, 120-volt power supplies (250) applied to the logic board (260) and battery charging circuit (270). The logic board (260 uses a DC power supply to provide power to the logic components (explained further hereafter). Inputs to the logic board are: two sensing pins (230), two selector switches (160) RJ-11 jack (200) and DC power (280) from the rechargeable batteries (290). Outputs are: audible alert (180) and two alarm LED lights (170) and the charging LED (190). The battery charging circuitry (270) has temperature and timing circuits (not shown) to monitor the status of the battery pack to ensure the batteries (290) are not over charged or charged too rapidly. The charging LED light (190) will flash on and off if the batteries (290) are not fully charged. The charging LED light (190) will remain continuously illuminated when the batteries (290) are fully charged and ready for use.

After the initial charge the alternative embodiment of the present invention will function automatically when an appliance cord is plugged into the present invention and the corresponding Normal-Off switch (160) is place in the Normal position. Upon loss of power (at either receptacle) the audible signal (180) will sound. The corresponding LED (170) below the Normal-Off switch (160) will flash indicating which receptacle is in alarm. Placing the selector switch/s (160) in the Off position will silence the audible signal (180). The flashing LED (170) will remain continuously illuminated indicating that an alarm condition exists on that receptacle. When power is restored the audible signal (180) will sound and the LED (170) will begin to flash indicating that the Normal-Off switch (160) is in the Off position. When the Normal-Off switch/s (160) are placed in the Normal position the audible signal (180) will silence and the LED/s (170) will remain off.

The optional RJ-11 jack (200) capability available on this embodiment will activate the dialer (not shown) only when, either of the switches (160) is in the Normal position and the audible signal (180) has been activated. The dialer (not shown) will make three attempts to contact the programmed phone number each hour until a connection is made or the audible signal (180) is silenced or power has been restored.

Units equipped with the RJ-11 jack (200) capability will be furnished with a small hand held programming tool (not shown) that plugs into the RJ-11 jack (200) to program the present invention. The programming tool will allow the user to program a phone number to be notified and a unique four digit code that will be stated in the message that is sent to the programmed phone number. When a connection is made an electronic generated voice will state a message similar to: "Power failure has occurred at 1234".

A further alternative embodiment is designed for the commercial refrigeration market but can have applications on other critical equipment such as heating equipment or ejector pumps. The alternative embodiment will alert users of a power failure at a specific piece of equipment. The device is hardwired into the power source of any critical piece of equipment. A two-position selector switch, located on the body, allows the user to activate or deactivate the unit. The switch positions are Normal and Off. This alternative embodiment is designed for commercial applications to be installed by a qualified electrician. This unit will be available in several different voltage configurations, 120-volt, 208/240-volt and 480-volt.

While the present invention has been described with particular reference to the illustrated embodiments, it is to be understood that numerous changes and modifications may be made therein without departing from the spirit and the scope of the invention as defined in the appended claims.

I claim:

1. A power failure alarm with additional lighting attributes, comprising:

a main body;

a logic board within said main body;

a battery charging circuit within said main body and in communication with said logic board;

a two prong 120 volt plug in communication with said logic board and said battery charging circuit;

a selector switch in communication with said logic board and main body;

a sensing pin in communication with said logic board and main body;

a light level sensor in communication with said logic board and main body;

an audible signal in communication with said logic board and main body;

a flashlight in communication with said logic board and main body;

a security light in communication with said logic board and main body;

a charge indicator light in communication with said battery charging circuit; and at least one rechargeable battery in communication with said battery charging circuit.

2. The device of claim 1, wherein said selector switch turns on and off said flashlight.

3. The device of claim 1, wherein said light level sensor detects the amount of ambient light.

4. The device of claim 1, wherein said light level sensor turns on or off said security light when a predetermined amount of ambient light is detected.

5. The device of claim 1, wherein said audible signal sounds when power is removed from said logic board.

6. The device of claim 1, wherein said flashlight is made up of a series of LED lights within a reflective housing.

7. The device of claim 1, wherein said security light is an LED light.

8. The device of claim 1, wherein said charge indicator light flashes intermittently while said at least one rechargeable battery is recharging.

9. The device of claim 1, wherein said charge indicator light will be solid when said at least one rechargeable battery is completely charged.

10. The device of claim 1, wherein said two prong plug can fold away.

11. The device of claim 1, wherein said sensing pin detects when the unit is in use.

* * * * *